US010113256B2

(12) United States Patent
Kongo et al.

(10) Patent No.: US 10,113,256 B2
(45) Date of Patent: Oct. 30, 2018

(54) EMBROIDERY CONVERSION DEVICE FOR EMBROIDERY SEWING MACHINE, EMBROIDERY CONVERSION METHOD FOR EMBROIDERY SEWING MACHINE, AND RECORDING MEDIUM STORING EMBROIDERY CONVERSION PROGRAM FOR EMBROIDERY SEWING MACHINE

(71) Applicant: Janome Sewing Machine Co., Ltd., Tokyo (JP)

(72) Inventors: Takeshi Kongo, Tokyo (JP); Kyoko Ishii, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 572 days.

(21) Appl. No.: 14/634,593

(22) Filed: Feb. 27, 2015

(65) Prior Publication Data

US 2016/0053420 A1 Feb. 25, 2016

(30) Foreign Application Priority Data

Aug. 21, 2014 (JP) ..... 2014-168790

(51) Int. Cl.
*D05B 19/10* (2006.01)
*D05C 5/04* (2006.01)

(52) U.S. Cl.
CPC ..... *D05B 19/10* (2013.01); *D05C 5/04* (2013.01)

(58) Field of Classification Search
CPC ..... D05B 19/02; D05B 19/08; D05B 19/10; D05B 19/105; D05C 5/00; D05C 5/02; D05C 5/04; D05C 5/06
(Continued)

(56) References Cited

U.S. PATENT DOCUMENTS 4,557,207 A * 12/1985 Turner ..... D05B 19/08 112/454
4,622,907 A * 11/1986 Kimura ..... D05B 19/08 112/102.5

(Continued)

FOREIGN PATENT DOCUMENTS

JP H11-114259 A 4/1999
JP H11-169568 A 6/1999

OTHER PUBLICATIONS

Office Action issued in JP Patent Application No. 2014-168790 dated Jul. 3, 2018 with English Translation (6 pages).

*Primary Examiner* — Nathan Durham
(74) *Attorney, Agent, or Firm* — Nakanishi IP Associates, LLC

(57) ABSTRACT

Provided is an embroidery conversion device for an embroidery sewing machine including: a base-color setting unit configured to set a base color; a gradation-data generating unit configured to generate gradation data expressing shading for monotone embroidery, based on an embroidery color specified for each of the embroidery areas; a gradation shade-number setting unit configured to set a number of shades in gradation for monotone embroidery used in execution of monotone embroidery; a gradation-data converting unit configured to convert the gradation data generated by the gradation-data generating unit into working gradation data of the number of shades in gradation set by the gradation shade-number setting unit, and to set the working gradation data as the embroidery color display data; and a recording unit configured to collectively record the embroidery color display data specified for each of the embroidery areas and embroidery stitch data.

8 Claims, 6 Drawing Sheets

(58) Field of Classification Search
USPC ..... 112/102.5, 447, 475.19; 700/136, 138
See application file for complete search history.

(56) References Cited

U.S. PATENT DOCUMENTS 4,742,786 A * 5/1988 Hashimoto ..... D05B 19/08 112/102.5
4,932,342 A * 6/1990 Hisatake ..... D05B 19/12 112/103
4,998,489 A * 3/1991 Hisatake ..... D05B 19/08 112/103
5,029,540 A * 7/1991 Hisatake ..... D05B 19/12 112/102.5
5,072,680 A * 12/1991 Nakashima ..... D05B 19/12 112/445
5,074,229 A * 12/1991 Sasako ..... D05B 19/16 112/102.5
5,107,778 A * 4/1992 Hisatake ..... D05B 19/12 112/103
5,335,182 A * 8/1994 Asano ..... D05B 19/10 112/102.5
5,390,615 A * 2/1995 Sugimoto ..... D05B 19/10 112/102.5
5,662,055 A * 9/1997 Hartwig ..... D05B 19/04 112/102.5
5,740,056 A * 4/1998 Futamura ..... D05B 19/08 112/456
5,740,057 A * 4/1998 Futamura ..... D05B 19/085 112/102.5
5,748,480 A * 5/1998 Mizuno ..... D05B 19/08 112/103
5,751,583 A * 5/1998 Kyuno ..... D05B 19/08 112/102.5
5,791,270 A * 8/1998 Mori ..... D05B 19/10 112/102.5
5,894,294 A * 4/1999 Morita ..... D05B 19/085 345/157
5,896,295 A * 4/1999 Matsushita ..... D05B 19/10 112/102.5
5,921,194 A * 7/1999 Komuro ..... D05B 19/105 112/102.5
5,924,372 A * 7/1999 Okuda ..... D05B 19/105 112/102.5
5,954,004 A * 9/1999 Futamura ..... D05B 19/105 112/102.5
5,964,168 A * 10/1999 Komuro ..... D05B 19/10 112/102.5
6,032,594 A * 3/2000 Komuro ..... D05B 19/08 112/102.5
6,032,595 A * 3/2000 Okuyama ..... D05B 19/006 112/102.5
6,032,596 A * 3/2000 Hayakawa ..... D05B 19/085 112/102.5
6,161,491 A * 12/2000 Takenoya ..... D05B 19/02 112/102.5
6,321,670 B1 * 11/2001 Tomita ..... D05B 19/105 112/102.5
6,321,671 B1 * 11/2001 Tomita ..... D05B 19/006 112/102.5
6,324,441 B1 * 11/2001 Yamada ..... D05B 19/08 112/102.5
6,407,745 B1 * 6/2002 Yamada ..... G06T 11/60 345/593
7,983,783 B2 * 7/2011 Hayakawa ..... D05B 19/08 112/470.01
7,996,103 B2 * 8/2011 Yamada ..... D05C 5/00 112/102.5
8,186,289 B2 * 5/2012 Tokura ..... D05B 19/16 112/102.5
8,196,535 B2 * 6/2012 Tokura ..... D05B 19/10 112/470.01
8,267,024 B2 * 9/2012 Hayakawa ..... D05B 19/10 112/470.01
8,342,112 B2 * 1/2013 Fujihara ..... D05B 19/12 112/470.04
8,463,420 B2 * 6/2013 Tokura ..... D05C 13/02 112/475.19
8,527,083 B2 * 9/2013 Tokura ..... D05B 19/10 112/102.5
8,539,893 B2 * 9/2013 Tokura ..... D05B 19/12 112/102.5
8,561,559 B2 * 10/2013 Okuyama ..... D05B 19/12 112/102.5
8,700,200 B2 * 4/2014 Tokura ..... D05C 5/06 112/102.5
8,733,261 B2 * 5/2014 Mizuno ..... D05B 19/08 112/102.5
8,738,172 B2 * 5/2014 Muto ..... D05C 5/04 700/138
8,738,173 B2 * 5/2014 Tokura ..... D05B 19/10 700/138
8,763,541 B2 * 7/2014 Tokura ..... D05C 5/06 112/102.5
8,869,721 B2 * 10/2014 Suzuki ..... D05B 19/12 112/102.5
8,893,633 B2 * 11/2014 Tokura ..... D05B 3/06 112/447
9,109,314 B2 * 8/2015 Maki ..... D05B 19/02
9,290,871 B2 * 3/2016 Kato ..... D05B 19/10
9,303,346 B2 * 4/2016 Kobayashi ..... D05C 9/04
9,624,610 B2 * 4/2017 Kongo ..... D05B 19/12
2001/0041946 A1 * 11/2001 Takayuki ..... D05B 19/08 700/138
2005/0171628 A1 * 8/2005 Suzuki ..... D05B 19/08 700/138
2005/0234584 A1 * 10/2005 Mizuno ..... D05B 19/08 700/138
2005/0234585 A1 * 10/2005 Muto ..... D05B 19/08 700/138
2006/0027154 A1 * 2/2006 Naka ..... D05B 19/105 112/470.01
2006/0096510 A1 * 5/2006 Kuki ..... D05B 19/08 112/102.5
2007/0014436 A1 * 1/2007 Muto ..... D05C 5/00 382/111
2007/0032899 A1 * 2/2007 Mizuno ..... D05B 19/08 700/138
2007/0088452 A1 * 4/2007 Suzuki ..... D05B 19/08 700/138
2008/0196645 A1 * 8/2008 Ikeba ..... D05B 19/04 112/470.01
2009/0188415 A1 * 7/2009 Tokura ..... D05B 19/10 112/470.01
2009/0312861 A1 * 12/2009 Hirose ..... D05B 3/06 700/136
2010/0024700 A1 * 2/2010 Kongo ..... D05B 19/10 112/80.23
2010/0050914 A1 * 3/2010 Kongo ..... D05B 19/10 112/78
2010/0139538 A1 * 6/2010 Tashiro ..... D05B 19/10 112/102.5
2010/0206204 A1 * 8/2010 Shimizu ..... D05B 39/00 112/102.5
2010/0228383 A1 * 9/2010 Taguchi ..... D05B 19/10 700/138
2012/0067263 A1 * 3/2012 Ikeba ..... D05B 19/10 112/470.04
2012/0116569 A1 * 5/2012 Yamada ..... D05B 19/10 700/138
2012/0150337 A1 * 6/2012 Kato ..... D05B 19/12 700/136
2012/0203372 A1 * 8/2012 Goldman ..... D05B 19/12 700/138
2012/0272884 A1 * 11/2012 Tokura ..... D05B 19/08 112/470.01
2013/0074749 A1 * 3/2013 Kato ..... D05B 19/02 112/102.5
2013/0079915 A1 * 3/2013 Ihira ..... D05B 19/10 700/138

(56) References Cited

U.S. PATENT DOCUMENTS

| | | | | |
|---|---|---|---|---|
| 2013/0112127 | A1* | 5/2013 | Tokura | D05C 5/06 112/102.5 |
| 2013/0186316 | A1* | 7/2013 | Mizuno | D05B 19/10 112/102.5 |
| 2014/0000498 | A1* | 1/2014 | Yamanashi | D05B 19/12 112/102.5 |
| 2014/0116308 | A1* | 5/2014 | Yamada | D05B 19/12 112/102.5 |
| 2014/0230707 | A1* | 8/2014 | Suzuki | D05B 19/12 112/102.5 |
| 2015/0005922 | A1* | 1/2015 | Okuyama | D05B 19/10 700/138 |
| 2015/0259841 | A1* | 9/2015 | Ihira | D05C 5/04 112/102.5 |
| 2015/0345057 | A1* | 12/2015 | Kongo | D05B 43/00 112/470.05 |
| 2016/0053420 | A1* | 2/2016 | Kongo | D05B 19/10 112/102.5 |
| 2016/0060799 | A1* | 3/2016 | Kongo | D05B 19/02 700/136 |
| 2016/0122929 | A1* | 5/2016 | Koike | D05B 69/30 112/475.17 |
| 2016/0215423 | A1* | 7/2016 | Kongo | D05B 19/12 |
| 2017/0073864 | A1* | 3/2017 | Nakajima | D05B 19/003 |

* cited by examiner

EMBROIDERY CONVERSION DEVICE FOR EMBROIDERY SEWING MACHINE, EMBROIDERY CONVERSION METHOD FOR EMBROIDERY SEWING MACHINE, AND RECORDING MEDIUM STORING EMBROIDERY CONVERSION PROGRAM FOR EMBROIDERY SEWING MACHINE

CROSS REFERENCE TO RELATED APPLICATIONS

This application is based on and claims the benefit of priority to Japanese Patent Application No. 2014-168790 filed on Aug. 21, 2014, the contents of which are hereby incorporated by reference in their entirety.

TECHNICAL FIELD

The present invention relates to an embroidery conversion device for an embroidery sewing machine capable of automatically performing embroidery using threads of a plurality of colors, an embroidery conversion method for such an embroidery sewing machine, and a recording medium storing an embroidery conversion program for such an embroidery sewing machine.

BACKGROUND ART

A recent multi-color embroidery sewing machine is provided with embroidery color display data and embroidery data for each of embroidery areas, and is capable of changing colors so as to finish embroidery in any color by selecting and specifying embroidery areas that are displayed, and by having color specification for the embroidery areas and embroidery data for the selected embroidery areas be recorded.

One method for utilization of this function is to use multi-scale monotone color embroidery specification, in contrast to original multi-color embroidery specification. However, it is not easy for a user to determine the multi-scale color by the user's own. In order to convert embroidery color display data of multiple colors into monotone data, it is necessary to first find out RGB values of all thread types used in a pattern, for example, and then determine thread colors taking balance as a whole into account. Conventionally, it has been extremely difficult to convert embroidery color display data of multiple colors into monotone data as described above.

Further, in addition to simple conversion of embroidery color display data of multiple colors into the monotone data, there is a case in which single-color embroidery without gradation using embroidery color display data of multiple colors is desired, and a case in which embroidery with a fewer number, although multiple, of shades in gradation using embroidery color display data of multiple colors is desired. For example, in a case of performing embroidery in one color, it is often not possible to provide an intended pattern as the pattern may go out of shape when colors of all threads in embroidery color display data of multiple colors are simply changed into the same color. Further, when the number of shades in gradation is desired to be decreased, it is necessary to set embroidery areas to which different colors are specified to have the same gradation level. However, it is difficult to determine which colors should be set to have the same gradation level.

Patent Literature 1 discloses a thread-color setting device that changes thread colors for embroidery based on a sensitivity word that has been input.

However, with the device disclosed in JP-A-11-114259, while it is easily possible to change the thread colors, it is not possible to decrease a number of colors (number of threads). In the case of monotone, to decrease the number of colors means to decrease a number of shades in gradation. In a case in which monotone embroidery is attempted using the device disclosed in Patent Literature 1, it is necessary to prepare a large number of threads of the same color but with different intensity or the like if embroidery data of a design with a large number of colors is used. In monotone embroidery, using a large number of threads is often ineffective, and a result worth the labor required for preparation may not possibly be obtained.

CITATION LIST

Patent Literature

[Patent Literature 1] Japanese Patent Application Laid-Open No. H11-114259

SUMMARY OF THE INVENTION

One or more embodiments of the present invention provide an embroidery conversion device for an embroidery sewing machine, an embroidery conversion method for an embroidery sewing machine, and an embroidery conversion program for an embroidery sewing machine, with which device, method, or program, it is possible to easily convert color embroidery data specified for multi-color embroidery into embroidery data of a monotone embroidery color by specifying a color as a base for monotone embroidery and a number of shades in gradation.

Embodiment (1): One or more embodiments of the present invention provides an embroidery conversion device for an embroidery sewing machine having embroidery color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the device including: a base-color setting unit configured to set a base color used in monotone embroidery in which embroidery is formed in shades of one color entirely over the embroidery areas; a gradation-data generating unit configured to generate gradation data expressing shading for monotone embroidery, based on an embroidery color specified for each of the embroidery areas; a gradation shade-number setting unit configured to set a number of shades in gradation for monotone embroidery used in execution of monotone embroidery; a gradation-data converting unit configured to convert the gradation data generated by the gradation-data generating unit into working gradation data of the number of shades in gradation set by the gradation shade-number setting unit, and to set the working gradation data as the embroidery color display data; and a recording unit configured to collectively record the embroidery color display data specified for each of the embroidery areas and embroidery stitch data.

Embodiment (2): One or more embodiments of the present invention provides the embroidery conversion device for an embroidery sewing machine according to the first aspect, wherein the gradation-data generating unit generates the gradation data expressing shading for monotone embroidery, based on at least one of intensity, brightness, hue, and saturation of the embroidery color specified for each of the embroidery areas.

Embodiment (3): One or more embodiments of the present invention provides the embroidery conversion device for an embroidery sewing machine according to the first aspect, further including: a confirming unit configured to have the embroidery color display data and the embroidery stitch data recoded in the recording unit be displayed in a display unit, and to accept approval from a user.

Embodiment (4): One or more embodiments of the present invention provides the embroidery conversion device for an embroidery sewing machine according to the first aspect, further including: a thread-type setting unit configured to assign, from thread types, a thread of a color that is similar to the color set in the embroidery color display data set by the gradation-data converting unit.

Embodiment (5): one or more embodiments of the present invention provides the embroidery conversion device for an embroidery sewing machine according to the first aspect, wherein the gradation shade-number setting unit is able to set 1 as the number of shades in gradation for monotone embroidery used in execution of monotone embroidery.

Embodiment (6): One or more embodiments of the present invention provides an embroidery sewing machine including: the embroidery conversion device for an embroidery sewing machine as defined in the first aspect, wherein monotone embroidery is executed according to the embroidery color display data and the embroidery stitch data recorded in the recording unit.

Embodiment (7): One or more embodiments of the present invention provides an embroidery conversion method for an embroidery sewing machine having embroidery color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the method including: a step of, by a base-color setting unit, setting a base color used in monotone embroidery in which embroidery is formed in shades of one color entirely over the embroidery areas; a step of, by a gradation-data generating unit, generating gradation data expressing shading for monotone embroidery, based on an embroidery color specified for each of the embroidery areas; a step of, by a gradation shade-number setting unit, setting a number of shades in gradation for monotone embroidery used in execution of monotone embroidery; a step of, by a gradation-data converting unit, converting the gradation data generated by the gradation-data generating unit into working gradation data of the number of shades in gradation set by the gradation shade-number setting unit, and setting the working gradation data as the embroidery color display data; and a step of, by a recording unit, collectively recording the embroidery color display data specified for each of the embroidery areas and embroidery stitch data.

Embodiment (8): One or more embodiments of the present invention provides an recording medium storing an embroidery conversion program for an embroidery sewing machine having embroidery color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the program causing a computer to execute: a step of, by a base-color setting unit, setting a base color used in monotone embroidery in which embroidery is formed in shades of one color entirely over the embroidery areas; a step of, by a gradation-data generating unit, generating gradation data expressing shading for monotone embroidery, based on an embroidery color specified for each of the embroidery areas; a step of, by a gradation shade-number setting unit, setting a number of shades in gradation for monotone embroidery used in execution of monotone embroidery; a step of, by a gradation-data converting unit, converting the gradation data generated by the gradation-data generating unit into working gradation data of the number of shades in gradation set by the gradation shade-number setting unit, and setting the working gradation data as the embroidery color display data; and a step of, by a recording unit, collectively recording the embroidery color display data specified for each of the embroidery areas and embroidery stitch data.

According to the one or more embodiments of the present invention, it is possible to provide an embroidery conversion device for an embroidery sewing machine, an embroidery conversion method for an embroidery sewing machine, and a recording medium storing an embroidery conversion program for an embroidery sewing machine, with which device, method, or program, it is possible to easily convert color embroidery data specified for multi-color embroidery into embroidery data of a monotone embroidery color by specifying a color as a base for monotone embroidery and a number of shades in gradation.

DETAILED DESCRIPTION OF PREFERRED EMBODIMENTS

Hereinafter, an exemplary embodiment for implementing the present invention will be described with reference to the drawings.

Exemplary Embodiment

Figure 1:
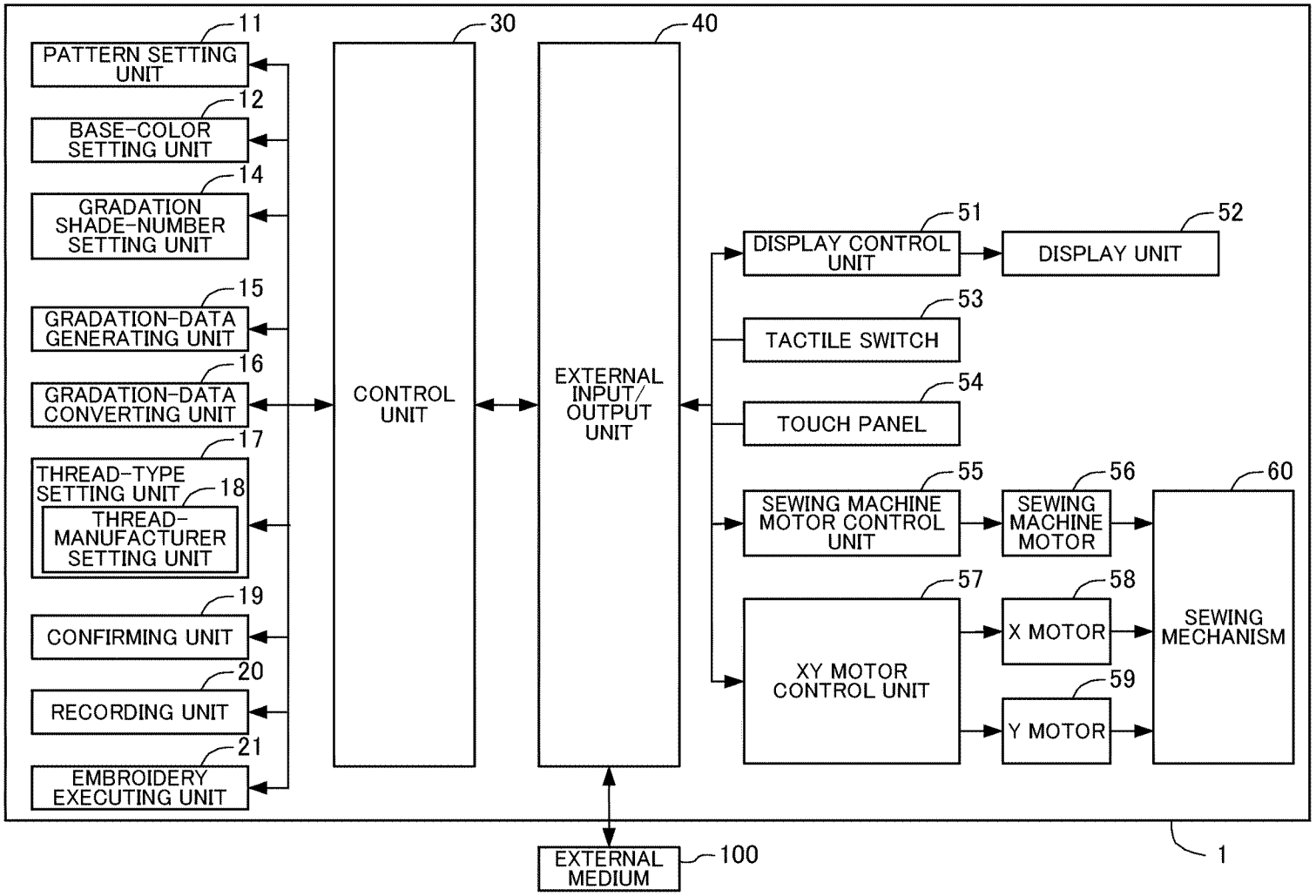
FIG. 1 is a diagram illustrating an exemplary embodiment of an embroidery sewing machine according to the present invention.

FIG. 1 is a diagram illustrating an exemplary embodiment of an embroidery sewing machine according to the present invention.

While specific values, configurations, and the like are referred in the following description, these are mere examples and may be modified as appropriate.

An embroidery sewing machine 1 of this exemplary embodiment has embroidery color display data and embroidery data for each of embroidery areas, and is capable of automatically performing embroidery using threads of a plurality of colors.

In addition to embroidery, the embroidery sewing machine 1 is capable of performing normal sewing.

The embroidery sewing machine 1 of this exemplary embodiment includes a pattern setting unit 11, a base-color setting unit 12, a gradation shade-number setting unit 14, a gradation-data generating unit 15, a gradation-data converting unit 16, a thread-type setting unit 17, a confirming unit 19, a recording unit 20, an embroidery executing unit 21, a control unit 30, an external input/output unit 40, a display control unit 51, a display unit 52, a tactile switch 53, a touch panel 54, a sewing machine motor control unit 55, a sewing machine motor 56, an XY motor control unit 57, an X motor 58, a Y motor 59, and a sewing mechanism 60.

The pattern setting unit 11 shows patterns recorded in the recording unit 20 or an external medium 100 such as a flash memory to a user so the user may select a pattern to be embroidered, and sets the pattern selected by the user as a pattern used in embroidery.

A previously set number of colors for the pattern that is set by the pattern setting unit 11 is set as an upper limit of shades in gradation.

The base-color setting unit 12 shows a plurality of base colors shown as examples in the display unit 52 to the user so the user may select abase color for monotone embroidery in which embroidery is formed in shades of one color entirely over embroidery areas, and sets the color selected by the user as a base color used in monotone embroidery.

The gradation shade-number setting unit 14 sets a number of shades in gradation for monotone embroidery to be actually performed according to the user's operation. For the number of shades in gradation that may be set by the gradation shade-number setting unit 14, the previously set number of colors for the pattern set by the pattern setting unit 11 is set as an upper limit of shades in gradation.

The gradation-data generating unit 15 generates gradation data expressing shading for monotone embroidery, based on a color in color embroidery specified for each of the embroidery areas in the embroidery pattern set by the pattern setting unit 11. Therefore, a number of shades in gradation in the gradation data generated by the gradation-data generating unit 15 corresponds to a number of colors (number of threads) in the original embroidery pattern.

The gradation-data converting unit 16 converts the gradation data generated by the gradation-data generating unit 15 into working gradation data for monotone embroidery of the number of shades in gradation set by the gradation shade-number setting unit 14, and then sets the working gradation data as the embroidery color display data. The gradation-data converting unit 16 also displays a monotone embroidery pattern that is to be actually embroidered, in the display unit 52, based on the embroidery color display data for monotone embroidery that has been set.

The thread-type setting unit 17 includes a thread-manufacturer setting unit 18. The thread-manufacturer setting unit 18 sets a manufacturer of threads to be used in embroidery according to the user's operation. The thread-type setting unit 17 assigns, from a range of thread types (a set of threads) of the thread manufacturer set by the thread-manufacturer setting unit 18, a thread of a color that is similar to the color set in the embroidery color display data set by the gradation-data converting unit 16.

The confirming unit 19 makes a request the user seeing the monotone embroidery pattern that is to be actually embroidered displayed by the gradation-data converting unit 16 to confirm whether or not monotone embroidery to be performed is approved.

The recording unit 20 collectively records the embroidery color display data specified for each of the embroidery areas and embroidery stitch data that have been confirmed by the confirming unit 19 that the user has approved.

Further, in order to allow the thread-type setting unit 17 to select the thread type, the recording unit 20 previously records information relating to thread types available from various thread manufacturers, in particular, information relating to thread colors. The information recorded in the recording unit 20 may be added or altered as needed in order to respond to release of new products of threads.

The recording unit 20 includes a ROM and a RAM as memory areas, and the memory area to be used is selected appropriately based on the data.

The embroidery executing unit 21 executes monotone embroidery based on the embroidery color display data and the embroidery stitch data that are recorded collectively in the recording unit 20.

The control unit 30 is a central processing unit that controls operations of the embroidery sewing machine 1 both as an embroidery conversion device and as an embroidery sewing machine in an integrated manner. The function of the control unit 30 may be achieved by configuring a single-purpose control circuit, or by executing a program recorded in the recording unit 20. Further, the functions of the pattern setting unit 11, the base-color setting unit 12, the gradation shade-number setting unit 14, the gradation-data generating unit 15, the gradation-data converting unit 16, the thread-type setting unit 17, the confirming unit 19, and the embroidery executing unit 21 described above may be achieved as a part of the function of the control unit 30.

The external input/output unit 40 is an interface through which the control unit 30 sends and receives data to and from outside.

The display control unit 51 controls display of patterns and letters in the display unit 52, under control of the control unit 30.

The display unit 52 is configured for example by a liquid crystal display, and displays patterns and letters under control of the display control unit 51.

The pattern setting unit 11, the base-color setting unit 12, the gradation shade-number setting unit 14, the gradation-data generating unit 15, the gradation-data converting unit 16, the thread-type setting unit 17, the confirming unit 19, the recording unit 20, the embroidery executing unit 21, the control unit 30, the external input/output unit 40, the display control unit 51, and the display unit 52 described above constitute the embroidery conversion device of the embroidery sewing machine 1.

The tactile switch 53 and the touch panel 54 are disposed at positions operable by the user. When the user operates the switch or the panel, a signal corresponding to the operation is transmitted to the control unit 30. The touch panel 54 is provided lapping over the display unit 52, and the display unit 52 and the touch panel 54 constitute a display operating unit in an integrated manner.

The sewing machine motor control unit 55 drives and controls the sewing mechanism 60 under control of the control unit 30 via the sewing machine motor 56, and controls a needle bar (not shown).

The sewing machine motor 56 is controlled by the sewing machine motor control unit 55, and generates a driving force necessary for driving the sewing mechanism 60.

The XY motor control unit 57 drives and controls the X motor 58 and the Y motor 59 under control of the control unit 30, and moves an embroidery frame (not shown) of the sewing mechanism 60 in an X direction and a Y direction.

A needle drop position is determined based on a command to the X motor 58 and the Y motor 59, and a stitch is formed.

The X motor 58 and the Y motor 59 are controlled by the XY motor control unit 57, and generate driving forces for moving the embroidery frame of the sewing mechanism 60 within a plane perpendicular to a moving direction of the needle bar (XY plane).

The sewing mechanism 60 includes a driving mechanism of the embroidery frame and a driving mechanism of the needle bar, and is driven by the driving forces from the sewing machine motor 56, the X motor 58, and the Y motor 59 as described above.

Next, an operation of the embroidery sewing machine 1 when performing monotone embroidery will be described with reference to a specific example. Described herein is an example in which 2-shade monotone embroidery with sepia as the base color is performed based on embroidery data of four colors.

First, the user selects embroidery data including a plurality of color change commands while looking at the display unit 52 of the embroidery sewing machine 1. Upon selection of the embroidery data, the control unit 30 controls the operation to move to an edit screen.

Next, the user presses a monotone key displayed in the edit screen in the display unit 52 to open a screen for monotone setting.

Figure 2:
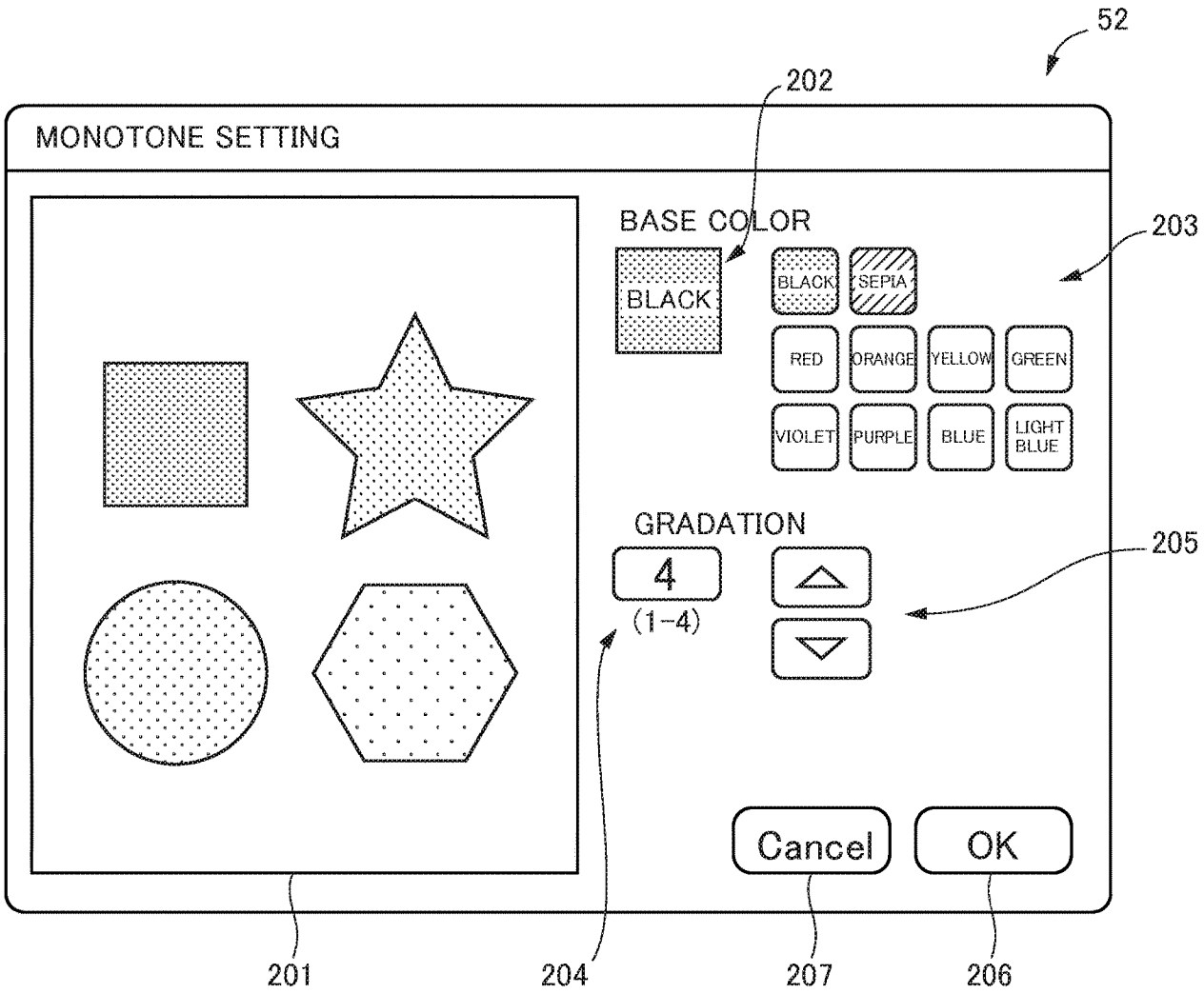
FIG. 2 is a view of a display unit 52 immediately after a screen for monotone setting is opened.

FIG. 2 is a view of the display unit 52 immediately after the screen for monotone setting is opened.

The screen for monotone setting displays a preview area 201, a base color display unit 202, base color keys 203, a gradation shade-number display unit 204, increase/decrease keys 205, an OK key 206, and a Cancel key 207.

The preview area 201 is an area for displaying the selected embroidery data after monotone conversion according to current monotone setting. In a state shown in FIG. 2, an initial value of the base color is set to black, and monotone embroidery data obtained by performing a monotone conversion process to color embroidery data taking black as the base color is displayed. Details of the monotone conversion process will be described later.

FIG. 2 shows a pattern, as an example, in which four shapes including square, star-shaped, circular, and hexagonal shapes are arranged. In this example, simple shapes are used in order to facilitate understanding. Actually, however, various kinds of complicated shapes such as human, animals, and plants are typically used. Further, in the example shown in FIG. 2, the number of shades in gradation is 4 for the sake of simplicity. In FIG. 2, shading is expressed by density of dots. The number of shades in gradation may also include a larger number of shades in gradation (such as 18 scales) according to the number of colors in the original color embroidery data.

The base color display unit 202 displays a color that is set as the base color. In FIG. 2, black as the initial value is displayed.

As the base color keys 203, a plurality of colors selectable as the base color are displayed side by side. In order to select the base color from the plurality of candidate colors that are displayed as the base color keys 203, the user touches a corresponding position. For example, when sepia (brown) is selected, a color pattern taking sepia as the base color is set. Further, it is possible to specify a previously determined basic color, such as blue based, green based, or red based color, as the base color.

In FIG. 2 and other drawings, letters designating the colors are shown in the base color display unit 202 and the base color keys 203 described above, in order to express the drawings in black and white. Actually, however, actual colors are displayed at these positions in color without showing the letters. Further, the colors and the letters may be displayed at the same time at these positions.

The gradation shade-number display unit 204 displays a number of shades in gradation that is currently set. In the state shown in FIG. 2, the number of shades in gradation is the same as the number of the colors in the color embroidery data, which is 4 in this example.

The increase/decrease keys 205 are key display for increasing or decreasing the number of shades in gradation, and expressed by a triangle and an inverted triangle.

Here, while the number of shades in gradation may be increased or decreased using the increase/decrease keys 205, a maximum number of the number of shades in gradation that may be set is the number of original colors. Further, a minimum number of the number of shades in gradation that may be set is 1, and in this case, single-color embroidery is performed using only the base color that has been specified.

The OK key 206 is key display for an operation of approval.

The Cancel key 207 is key display for an operation of cancelling.

In the state shown in FIG. 2, the control unit 30 assigns thread types of the thread manufacturer that has been separately set to the monotone embroidery data. At this stage, as black is initially set as the base color, one of black, white, and grey in a number of different tones that is closest to a thread type (thread number) corresponding to each of shades of colors subjected to monotone conversion process is searched. Then, the embroidery data is regenerated using the thread types of the thread manufacturer that has been set.

Next, the user touches a sepia key out of the base color keys 203 to select sepia as the base color.

Figure 3:
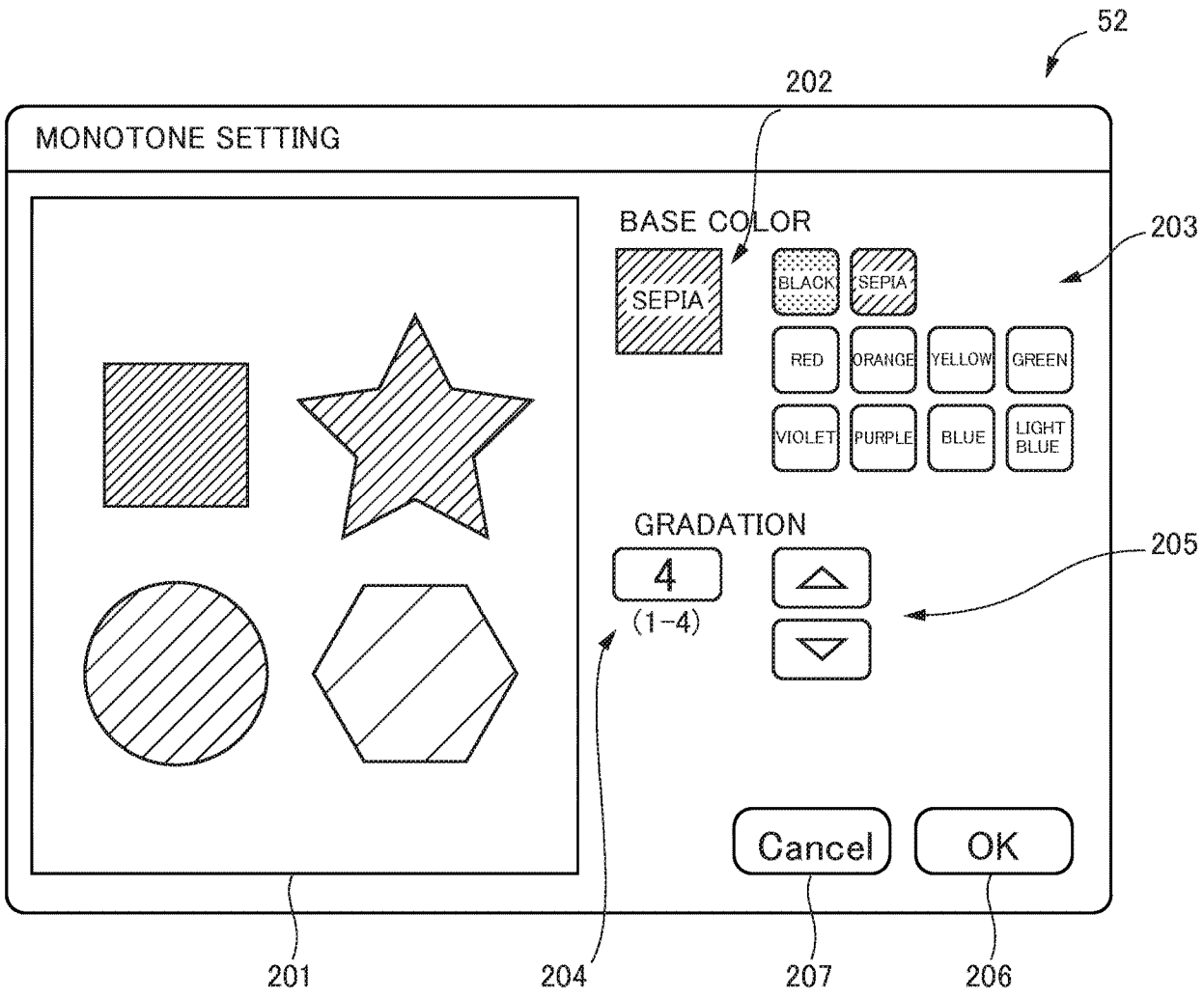
FIG. 3 is a view of the display unit 52 when sepia is selected as a base color.

FIG. 3 is a view of the display unit 52 when sepia is selected as the base color.

Upon selection of sepia as the base color, sepia is displayed in the base color display unit 202, and an image displayed in the preview area 201 is also displayed in a 4-shade monotone image taking sepia as the base color. From FIG. 3 through FIG. 5, sepia is expressed by hatching, and the shades are expressed by density of hatching lines.

Further, when sepia is selected as the base color, the thread-type setting unit 17 reassigns thread types of the thread manufacturer that has been set to the monotone embroidery data.

Then, the user operates the increase/decrease keys 205 to decrease the number of shades in gradation by one to 3 shades.

Figure 4:
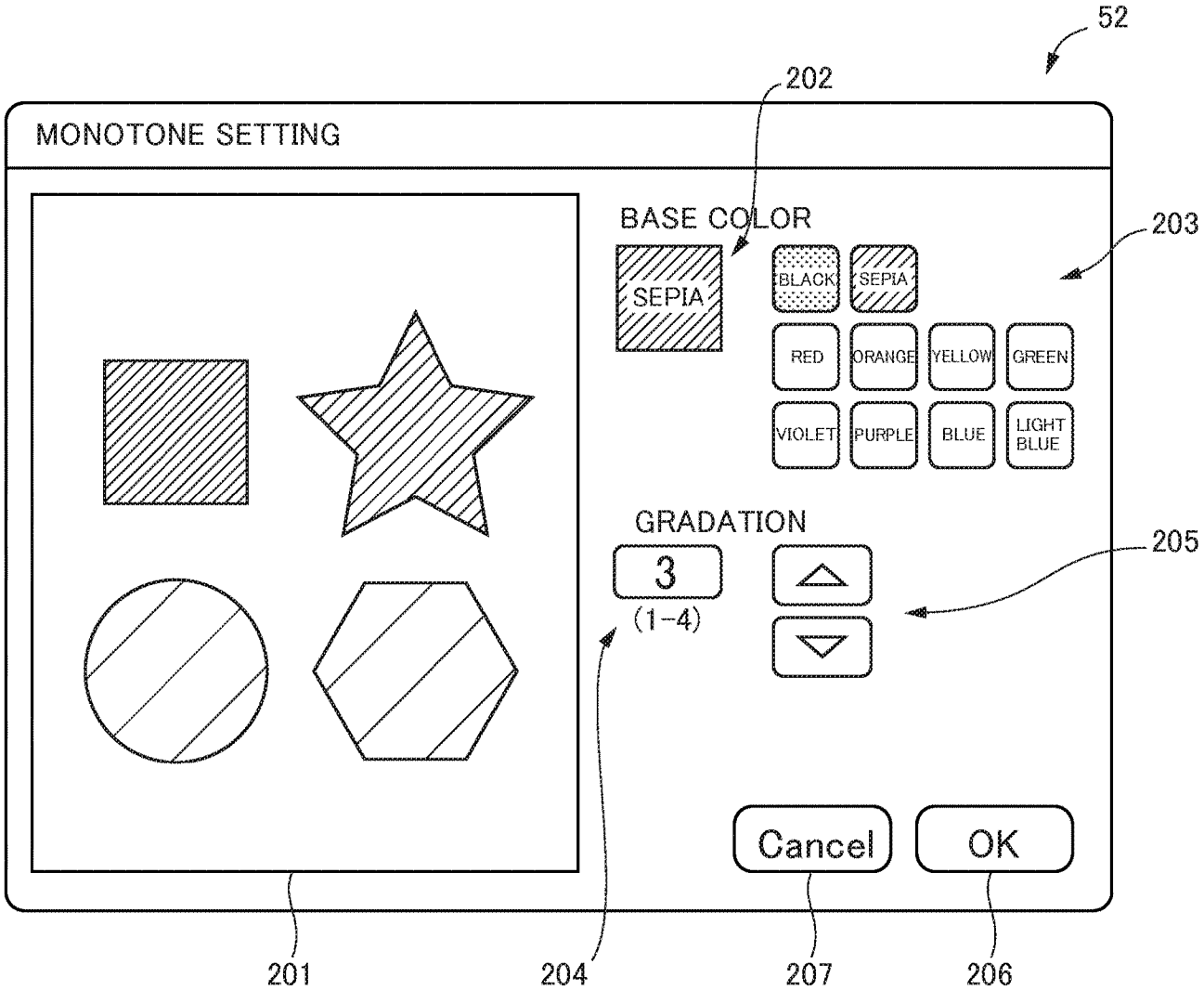
FIG. 4 is a view of the display unit 52 when 3 is set as a number of shades in gradation.

FIG. 4 is a view of the display unit 52 when 3 is set as the number of shades in gradation.

Upon setting 3 as the number of shades in gradation, "3" is displayed in the gradation shade-number display unit 204, and the preview area 201 also displays a 3-shade monotone image taking sepia as the base color.

In this case, as the number of shades in gradation is decreased, the colors of closer shading are integrated into the same tone.

Further, when the number of shades in gradation is changed, the thread-type setting unit 17 reassigns thread types of the thread manufacturer that has been set to the monotone embroidery data.

Subsequently, the user operates the increase/decrease keys 205 to further decrease the number of shades in gradation by one to 2 shades.

Figure 5:
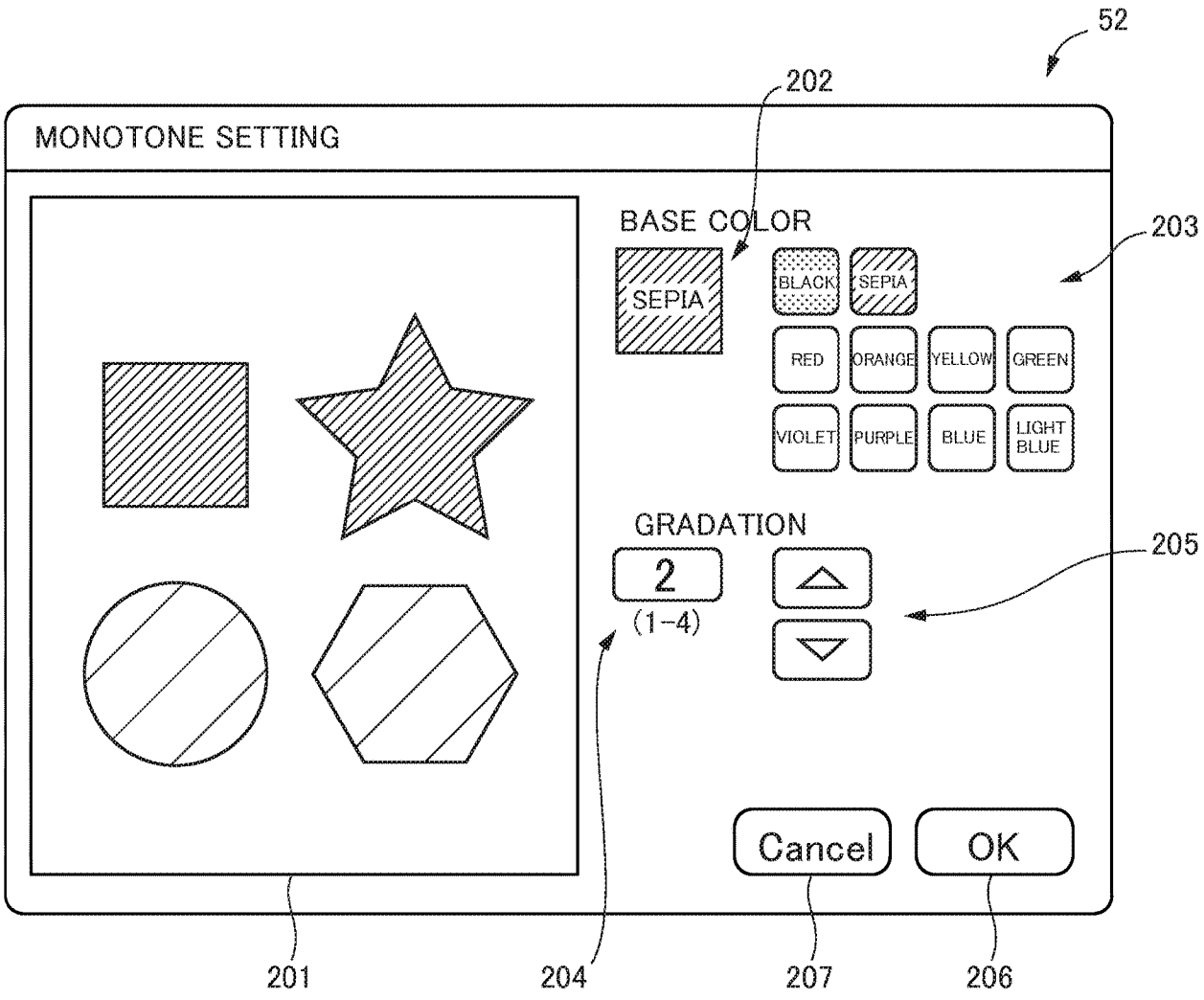
FIG. 5 is a view of the display unit 52 when 2 is set as the number of shades in gradation.

FIG. 5 is a view of the display unit 52 when 2 is set as the number of shades in gradation.

Upon setting 2 as the number of shades in gradation, "2" is displayed in the gradation shade-number display unit 204, and the preview area 201 also displays a 2-shade monotone image taking sepia as the base color.

Also in this case, when the number of shades in gradation is changed, the thread-type setting unit 17 reassigns thread types of the thread manufacturer that has been set to the monotone embroidery data.

Next, the user confirms the display in the preview area 201, and presses the OK key if the setting is approved. With this, the confirming unit 19 confirms the user's approval, the monotone setting is completed, and the display returns to the edit screen.

Next, the user operates a predetermined key to terminate an edit mode, and the display returns to an embroidery execution screen. Then, by the user pressing a start key (not shown), monotone embroidery is started under control of the embroidery executing unit 21.

Hereinafter, the monotone conversion process will be described in further detail.

Figure 6:
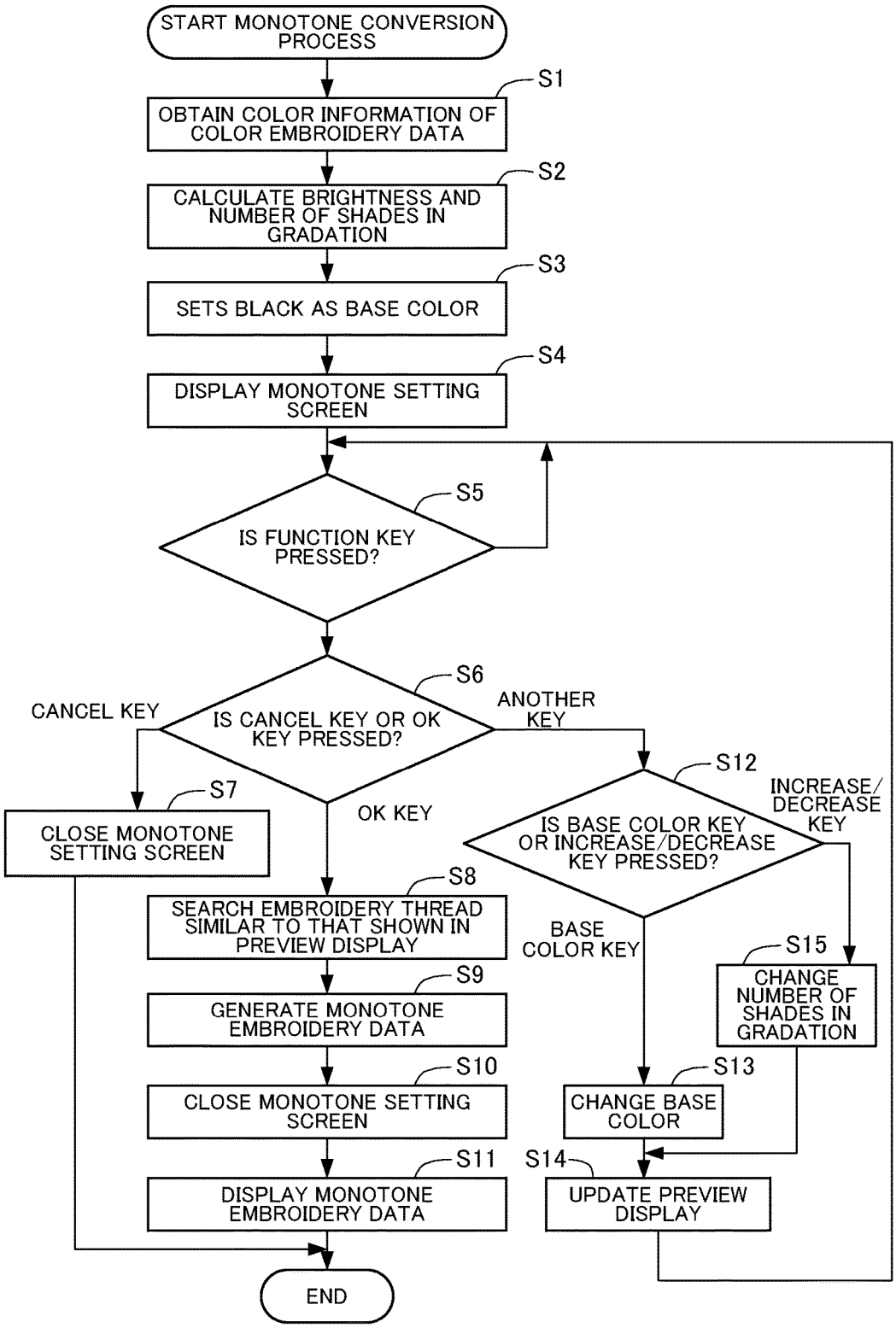
FIG. 6 is a flowchart showing a flow of an operation relating to monotone conversion process.

FIG. 6 is a flowchart showing a flow of an operation relating to the monotone conversion process.

Upon starting of the monotone conversion process by the user's operation, in Step (hereinafter simply referred to as S) 1, the gradation-data generating unit 15 obtains color information of the color embroidery data. Specifically, the control unit 30 obtains information as to colors used in respective embroidery areas in the selected color embroidery data.

In S2, the gradation-data generating unit 15 calculates and obtains brightness and a number of shades in gradation of the respective colors. Here, the number of shades in gradation obtained in S2 is the same as the number of colors in the color embroidery data. Further, the obtaining of brightness of the respective colors means conversion of the color embroidery data into data of brightness in achromatic colors as the gradation data.

In this process, the conversion into the data of brightness in achromatic colors is performed, for example, by the following expression.

$$Y=0.30R+0.59G+0.11B$$

Here, Y represents a brightness signal, R represents a red signal, G represents a green signal, and B represents a blue signal.

Brightness data for Y1, Y2, Y3, Y4, . . . is obtained from the respective colors in the embroidery data. With this, color components are removed, and achromatic monotone data is generated.

It should be noted that as brightness of black is zero and hue of the base color may not be added to black, the data is slightly shifted to gray.

With this, achromatic monotone data excluding components of the base color is generated.

In S3, the base-color setting unit 12 sets and stores an initial value of black (#000000) as the base color.

In S4, the control unit 30 displays a monotone setting screen (monotone setting dialogue) (FIG. 2).

In S5, the control unit 30 determines whether or not any of function keys (not shown) is pressed. Here, the function keys collectively refer to the base color keys 203, the increase/decrease keys 205, the OK key 206, and the Cancel key 207. Until any one of the function keys is pressed, the operation in S5 is repeated to wait for an input of a function key.

In S6, the confirming unit 19 determines whether or not one of the Cancel key 207 and the OK key 206 is pressed. If the Cancel key 207 is pressed, the monotone setting screen is closed straight (S7), and the monotone conversion process is terminated. If the OK key 206 is pressed, the operation moves to S8. If neither of the Cancel key 207 and the OK key 206 is pressed, the operation moves to S12, and determination on pressing of another function key is made.

In S8, as the OK key 206 is pressed, the thread-type setting unit 17 searches a similar thread color out of threads of the thread manufacturer that has been specified previously by the user. The thread-type setting unit 17 has a table of RGB values corresponding to the threads of the thread manufacturer, and makes a search by comparing distances between the RGB values to determine a thread color to which each color that has been subjected to the monotone conversion is close.

In S9, the control unit 30 displays the result in S8 in the preview area 201 of the monotone setting screen. Further, the gradation-data converting unit 16 generates monotone embroidery data based on this information.

In S10, the control unit 30 closes the monotone setting screen after the generation of the monotone embroidery data.

In S11, the control unit 30 displays the generated monotone embroidery data in the edit screen.

In S12, as neither of the Cancel key 207 and the OK key 206 is pressed in S6, the control unit 30 determines whether or not one of the base color keys 203 and the increase/decrease keys 205 is pressed. If one of the base color keys is pressed, the base-color setting unit 12 changes the base color (S13).

For example, when sepia is selected as the base color, a thread color is determined by obtaining RGB values by multiplying data of brightness of each thread color and a coefficient of sepia color as follows.

$$R=0.94*Y1*255$$

$$G=0.78*Y1*255$$

$$B=0.57*Y1*255$$

If the decrease key is pressed, the gradation shade-number setting unit 14 decreases the number of shades in gradation (S15), and colors of similar brightness are integrated. In this case, the colors may be integrated to one having a greater area of embroidery, or conversion into a color of intermediate brightness, for example, may be performed. Then, the operation moves to S14.

In S14, the control unit 30 updates the preview display in the preview area 201 according to the change of the base color or the number of shades in gradation. Then, the operation returns to S5, and waits until the user presses a function key.

As described above, according to this exemplary embodiment, the embroidery sewing machine 1 automatically performs the operation of conversion into monotone gradation data based on arrangement of colors in the color embroidery data without bothering the user. Further, the embroidery sewing machine 1 is able to easily generate monotone embroidery data using the base color specified by the user. Moreover, the embroidery sewing machine 1 is able to easily generate monotone embroidery data in a color combination in a varying number of shades in gradation by specifying the number of shades in gradation. By setting 1 as the number of shades in gradation, it is possible to generate embroidery data for single-color embroidery.

It is also possible to realize an embroidery conversion device and an embroidery conversion method according to the present invention by having the process of the embroidery conversion device be recorded in a computer-readable recording medium, and by having the embroidery conversion device read and execute a program recorded in the recording medium. As used herein, the computer includes an OS and hardware such as peripheral devices.

Further, when WWW (World Wide Web) is used, a website providing environment (or display environment) is also included in the computer. Moreover, the program may be transmitted from the computer having the program stored in a storage device or the like to another computer via a transmission medium. As used herein, the transmission medium has a function for transmitting information, like a network (communication network) such as the Internet or a telecommunication line (communication line) such as telephone line.

Further, the program may be for realizing a part of the function described above. Moreover, it is possible to realize the present invention by adding the program as a difference file (difference program) to a computer in which a certain program is installed.

Modified Embodiment

The present invention is not limited to the exemplary embodiment described above, and may be modified or altered in various ways, which are also included within the scope of the present invention.

For example, in this exemplary embodiment, the example in which the embroidery sewing machine 1 has the embroidery conversion device built therein is described. The present invention is not limited to such an example, and the function of the embroidery conversion device may be realized by a different type of a computer such as a tablet terminal or a personal computer. In this case, it is possible to realize the present invention by having the computer execute a program for realizing the function of the embroidery conversion device.

Further, in this exemplary embodiment, the example in which brightness of each color in the color embroidery data is calculated, and the gradation data is generated based on the calculated brightness is described. The present invention is not limited to such an example, and one or any combination of intensity, hue, and saturation, for example, in addition to brightness, may be obtained and used in generation of the gradation data.

While the exemplary embodiment and the modified embodiment may be used in an appropriate combination, detailed descriptions shall be omitted. Further, the present invention is not limited to the embodiments described above.

REFERENCE SIGNS LIST

1: embroidery sewing machine
11: pattern setting unit
12: base-color setting unit
14: gradation shade-number setting unit
15: gradation-data generating unit
16: gradation-data converting unit
17: thread-type setting unit
18: thread-manufacturer setting unit
19: confirming unit
20: recording unit
21: embroidery executing unit
30: control unit
40: external input/output unit
51: display control unit
52: display unit
53: tactile switch
54: touch panel
55: sewing machine motor control unit
56: sewing machine motor
57: motor control unit
58: X motor
59: Y motor
60: sewing mechanism
100: external medium
201: preview area
202: base color display unit
203: base color keys
204: gradation shade-number display unit
205: increase/decrease keys
206: OK key
207: Cancel key

What is claimed is:

1. An embroidery conversion device for an embroidery sewing machine having embroidery monotone color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the device comprising:

a base-color setting unit that sets a base color used in monotone embroidery in which embroidery is formed in shades of one color entirely over the embroidery areas;

a gradation-data generating unit that generates gradation data expressing shading for monotone embroidery, based on an embroidery color specified for each of the embroidery areas;

a gradation shade-number setting unit that allows a user to set a number of shades in gradation for monotone embroidery to be used in execution of monotone embroidery, within a limit determined based on a multicolor embroidery pattern to which a plurality of color threads are assigned;

a gradation-data converting unit that converts the gradation data generated by the gradation-data generating unit into working gradation data of the number of shades in gradation set by the gradation shade-number setting unit, and to set the working gradation data as the embroidery monotone color display data;

a recording unit that collectively records the embroidery monotone color display data specified for each of the embroidery areas and embroidery stitch data; and a control unit that controls the embroidery sewing machine to perform an embroidery operation of a monotone color image with gradation as an entire image converted from a multicolor image, based on the embroidery monotone color display data.

2. The embroidery conversion device for an embroidery sewing machine according to claim 1, wherein the gradation-data generating unit generates the gradation data expressing shading for monotone embroidery, based on at least one of intensity, brightness, hue, and saturation of the embroidery color specified for each of the embroidery areas.

3. The embroidery conversion device for an embroidery sewing machine according to claim 1, further comprising:

a confirming unit that has the embroidery monotone color display data and the embroidery stitch data recoded in the recording unit be displayed in a display unit, and to accept approval from a user.

4. The embroidery conversion device for an embroidery sewing machine according to claim 1, further comprising:

a thread-type setting unit that assigns, from thread types, a thread of a color that is similar to the color set in the embroidery monotone color display data set by the gradation-data converting unit.

5. The embroidery conversion device for an embroidery sewing machine according to claim 1, wherein the gradation shade-number setting unit is able to set 1 as the number of shades in gradation for monotone embroidery used in execution of monotone embroidery.

6. An embroidery sewing machine comprising:

the embroidery conversion device for an embroidery sewing machine as defined in claim 1, wherein monotone embroidery is executed according to the embroidery monotone color display data and the embroidery stitch data recorded in the recording unit.

7. An embroidery conversion method for an embroidery sewing machine having embroidery monotone color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the method comprising:

a step of, by a base-color setting unit, setting a base color used in monotone embroidery in which embroidery is formed in shades of one color entirely over the embroidery areas;

a step of, by a gradation-data generating unit, generating gradation data expressing shading for monotone embroidery, based on an embroidery color specified for each of the embroidery areas;

a step of, by a gradation shade-number setting unit, allowing a user to set a number of shades in gradation for monotone embroidery to be used in execution of monotone embroidery, within a limit determined based on a multicolor embroidery pattern to which a plurality of color threads are assigned;

a step of, by a gradation-data converting unit, converting the gradation data generated by the gradation-data generating unit into working gradation data of the number of shades in gradation set by the gradation shade-number setting unit, and setting the working gradation data as the embroidery monotone color display data;

a step of, by a recording unit, collectively recording the embroidery monotone color display data specified for each of the embroidery areas and embroidery stitch data; and a step of, by a control unit, controlling the embroidery sewing machine to perform an embroidery operation of a monotone color image with gradation as an entire image converted from a multicolor image, based on the embroidery monotone color display data.

8. A non-transitory recording medium storing an embroidery conversion program for an embroidery sewing machine having embroidery monotone color display data and embroidery data for each of embroidery areas, and capable of performing conversion for forming embroidery in a given embroidery color by selecting embroidery areas that are displayed to specify a color for the areas, and by having the color specification for the embroidery areas and embroidery data for the selected embroidery areas be recorded, the program causing a computer to execute:

a step of, by a base-color setting unit, setting a base color used in monotone embroidery in which embroidery is formed in shades of one color entirely over the embroidery areas;

a step of, by a gradation-data generating unit, generating gradation data expressing shading for monotone embroidery, based on an embroidery color specified for each of the embroidery areas;

a step of, by a gradation shade-number setting unit, allowing a user to set a number of shades in gradation for monotone embroidery used in execution of monotone embroidery, within a limit determined based on a multicolor embroidery pattern to which a plurality of color threads are assigned;

a step of, by a gradation-data converting unit, converting the gradation data generated by the gradation-data generating unit into working gradation data of the number of shades in gradation set by the gradation shade-number setting unit, and setting the working gradation data as the embroidery monotone color display data;

a step of, by a recording unit, collectively recording the embroidery monotone color display data specified for each of the embroidery areas and embroidery stitch data; and a step of, by a control unit, controlling the embroidery sewing machine to perform an embroidery operation of a monotone color image with gradation as an entire image converted from a multicolor image, based on the embroidery monotone color display data.

* * * * *